US010487847B2

(12) United States Patent
Veitch et al.

(10) Patent No.: US 10,487,847 B2
(45) Date of Patent: Nov. 26, 2019

(54) GAS TURBINE ENGINE BLADE CASING

(71) Applicant: PRATT & WHITNEY CANADA CORP., Longueuil (CA)

(72) Inventors: Thomas Veitch, Toronto (CA); Karan Anand, Mississauga (CA); Peter Townsend, Mississauga (CA); Tibor Urac, Mississauga (CA); Terry Brownridge, St-Lambert (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 265 days.

(21) Appl. No.: 15/410,060

(22) Filed: Jan. 19, 2017

(65) Prior Publication Data

US 2017/0204876 A1 Jul. 20, 2017

Related U.S. Application Data

(60) Provisional application No. 62/280,311, filed on Jan. 19, 2016.

(51) Int. Cl.
*F04D 29/52* (2006.01)
*F04D 29/16* (2006.01)
(Continued)

(52) U.S. Cl.
CPC ..... *F04D 29/526* (2013.01); *F04D 29/164* (2013.01); *F04D 29/324* (2013.01);
(Continued)

(58) Field of Classification Search
CPC .... F04D 29/526; F04D 29/164; F04D 29/324; F04D 29/685; F04D 29/644; F05D 2250/61; F05D 2250/294
See application file for complete search history.

(56) References Cited

U.S. PATENT DOCUMENTS 4,540,335 A * 9/1985 Yamaguchi ..... F01D 7/00 415/129
4,767,266 A * 8/1988 Holz ..... F01D 11/08 277/412

(Continued)

FOREIGN PATENT DOCUMENTS

CA 2895986 8/2017
EP 0774050 10/1999

(Continued)

*Primary Examiner* — Joseph J Dallo
(74) *Attorney, Agent, or Firm* — Norton Rose Fulbright Canada LLP

(57) ABSTRACT

A gas turbine engine is described having a rotor with a plurality of rotor blades each extending radially between a blade root to a blade tip and axially between a leading edge and a trailing edge. An annular casing body housing the rotor blades includes an abradable segment of the inner surface facing the blade tips and having an abradable member. The abradable segment having one or more annular grooves, extending into the casing body from an inner surface thereof, and including an edge groove axially aligned with and facing the leading edge or the trailing edge of the rotor blades. The edge groove extends axially between a first position on the inner surface upstream of the leading edge or the trailing edge, and a second position on the inner surface downstream of the leading edge or the trailing edge.

20 Claims, 3 Drawing Sheets

(51) Int. Cl.
*F04D 29/32* (2006.01)
*F04D 29/64* (2006.01)
*F04D 29/68* (2006.01)

(52) U.S. Cl.
CPC ..... *F04D 29/644* (2013.01); *F04D 29/685* (2013.01); *F05D 2250/294* (2013.01); *F05D 2250/61* (2013.01)

(56) References Cited

U.S. PATENT DOCUMENTS

| | | | | |
|---|---|---|---|---|
| 5,707,206 | A | 1/1998 | Goto et al. | |
| 6,234,747 | B1 | 5/2001 | Mielke et al. | |
| 6,499,940 | B2 | 12/2002 | Adams | |
| 7,972,109 | B2 | 7/2011 | Crall et al. | |
| 8,257,022 | B2 | 9/2012 | Guemmer | |
| 8,337,146 | B2 | 12/2012 | Yu | |
| 8,602,720 | B2 | 12/2013 | Goswami et al. | |
| 8,777,558 | B2 | 7/2014 | Brunet et al. | |
| 8,915,699 | B2 | 12/2014 | Brignole et al. | |
| 8,939,706 | B1 | 1/2015 | Lee et al. | |
| 9,004,859 | B2 | 4/2015 | Shahpar et al. | |
| 9,249,680 | B2 | 2/2016 | Lee et al. | |
| 9,528,443 | B2 | 12/2016 | Razzell et al. | |
| 9,556,743 | B2 | 1/2017 | Chamberlain et al. | |
| 9,624,789 | B2 | 4/2017 | Webster | |
| 9,631,506 | B2 | 4/2017 | Lee et al. | |
| 9,644,489 | B1 | 5/2017 | Tham et al. | |
| 9,752,780 | B2 | 9/2017 | Jones et al. | |
| 9,920,646 | B2 | 3/2018 | Lee et al. | |
| 2007/0160459 | A1* | 7/2007 | Tudor | F04D 29/526 415/119 |
| 2007/0212217 | A1* | 9/2007 | Northfield | F04D 29/164 415/200 |
| 2010/0310353 | A1* | 12/2010 | Yu | F01D 11/122 415/1 |
| 2013/0280047 | A1 | 10/2013 | Willett et al. | |
| 2014/0064938 | A1 | 3/2014 | Eriksen et al. | |
| 2015/0031272 | A1 | 1/2015 | Fulton et al. | |
| 2016/0153360 | A1 | 6/2016 | Jothiprasad et al. | |
| 2016/0236994 | A1 | 8/2016 | Vetters et al. | |
| 2016/0305285 | A1* | 10/2016 | Urac | F04D 29/685 |
| 2016/0348250 | A1 | 12/2016 | Ahmad | |
| 2016/0362989 | A1 | 12/2016 | Subramanian et al. | |
| 2016/0362997 | A1 | 12/2016 | Tham et al. | |
| 2016/0369636 | A1 | 12/2016 | Hitchman et al. | |
| 2017/0051614 | A1 | 2/2017 | Merrill, Jr. et al. | |
| 2017/0101883 | A1 | 4/2017 | Chamberlain et al. | |
| 2017/0175560 | A1 | 6/2017 | Merrill et al. | |
| 2017/0198715 | A1 | 7/2017 | Engebretsen et al. | |
| 2017/0204876 | A1* | 7/2017 | Veitch | F04D 29/685 |
| 2017/0218787 | A1 | 8/2017 | Lee et al. | |
| 2017/0276007 | A1 | 9/2017 | Rioux et al. | |
| 2018/0347579 | A1* | 12/2018 | Hiemaux | F01D 11/001 |

FOREIGN PATENT DOCUMENTS

| | | |
|---|---|---|
| EP | 2354276 | 10/2016 |
| EP | 2434102 | 10/2016 |
| EP | 3165774 | 5/2017 |
| IN | 285161 | 7/2017 |
| JP | 4942206 | 5/2012 |
| JP | 5591203 | 9/2014 |
| WO | 2017177229 | 10/2017 |

* cited by examiner

GAS TURBINE ENGINE BLADE CASING

CROSS-REFERENCE TO RELATED APPLICATIONS

The present application claims priority on U.S. Patent Application No. 62/280,311 filed Jan. 19, 2016, the entire content of which is incorporated herein by reference.

TECHNICAL FIELD

The application relates generally to gas turbine engines and, more particularly, to casings for rotor blades.

BACKGROUND

The provision of abradable material, in the compressor or turbine section of a gas turbine engine for example, is known. For instance a rotor made up of a plurality of blades is contained within a casing or shroud surrounding the blade tips, and a coating of abradable material may be provided on the inner surface of the surrounding casing or shroud. As the rotor rotates, the rotor blades may experience deflection or movement during operation of the engine, due to factors such as loads, shaft deflection, thermal growth, bearing failure, foreign object damage, etc. This deflection or movement can cause the outer tips of the rotor blades to rub against the abradable material of the casing and carve precisely defined grooves in the abradable material coating without contacting the outer casing or shroud itself.

This may help maintain an acceptable tip clearance for aerodynamic performance purposes, while preventing unnecessary contact between the outer casing or shroud itself and the blade rotors. However, as a result of the rubbing contact between the rotor blades and the abradable material, the rotor blades may nevertheless experience important rubbing loads that are consequently imparted to the rotor blades. These loads can stress the rotor blades and may lead to reduced lifespan of the rotor blades.

SUMMARY

There is accordingly provided a rotor blade casing for a gas turbine engine, the rotor blade casing adapted to enclose a rotor having a plurality of rotor blades and mounted to a shaft for rotation about a longitudinal center axis, each rotor blade extending radially between a blade root to a blade tip and extending axially between a leading edge and a trailing edge, the rotor blade casing comprising: an annular casing body housing the rotor blades and having an inner circumferential surface, an abradable segment of the inner surface axially aligned with and facing the blade tips, the abradable segment comprising an abradable member adapted to be rubbed against by the blade tips when the rotor blades expand or deflect radially away from the longitudinal center axis during operation of the gas turbine engine, the abradable segment having one or more annular grooves extending radially outwardly into the casing body from the inner surface, the one or more annular grooves including a leading edge groove axially aligned with the leading edges of the rotor blades, the leading edge groove extending axially between a first position on the inner surface and a second position on the inner surface, the first position being axially upstream of the leading edges and the second position being axially downstream of the leading edges.

There is also provided a gas turbine engine comprising: a rotor having a plurality of rotor blades and mounted to a shaft for rotation about a longitudinal center axis, each rotor blade extending radially between a blade root to a blade tip, and axially between a leading edge and a trailing edge; and an annular casing body housing the rotor blades and having an inner circumferential surface, an abradable segment of the inner surface facing the blade tips and spaced apart therefrom, the abradable segment comprising an abradable member being rubbed against by the blade tips when the rotor blades deflect during operation of the gas turbine engine, the abradable segment having one or more annular grooves extending into the casing body from the inner surface, the one or more annular grooves including an edge groove axially aligned with and facing the leading edge or the trailing edge of the rotor blades, the edge groove extending axially between a first position on the inner surface upstream of the leading edge or the trailing edge and a second position on the inner surface downstream of the leading edge or the trailing edge.

There is further provided a method of manufacturing a rotor blade casing of a gas turbine engine, the method comprising: providing an abradable member on at least a portion of an inner surface of the rotor blade casing; and forming one or more annular grooves in the abradable member at an axial location adapted to be axially aligned with blade tips of rotor blades enclosed by the rotor blade casing, the one or more annular grooves including an edge groove axially aligned with and adjacent to a leading edge or a trailing edge of the rotor blades.

BRIEF DESCRIPTION OF THE DRAWINGS

Reference is now made to the accompanying figures in which.

DETAILED DESCRIPTION

Figure 1:
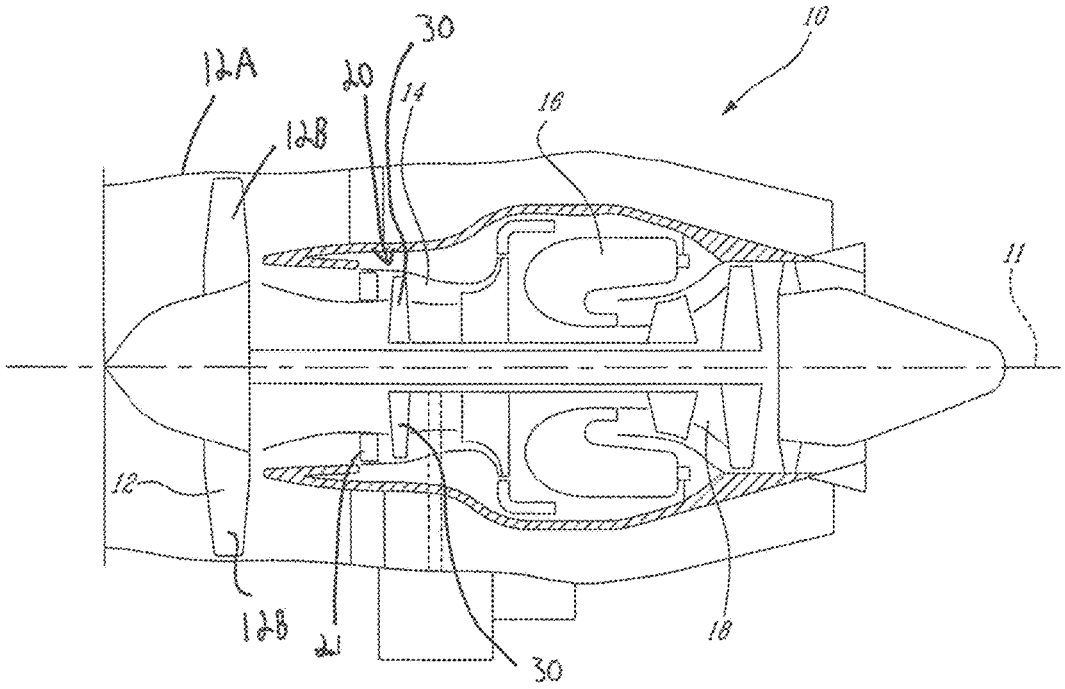
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has a longitudinal center axis 11 about which some of its components rotate.

The gas turbine engine 10 has various casings that house rotatable components. For example, a fan casing 12A houses the rotatable fan blades 12B of the fan 12. The compressor casing 20 of the compressor section 14 houses one or more rotor blades 21, 30.

Figure 2B:
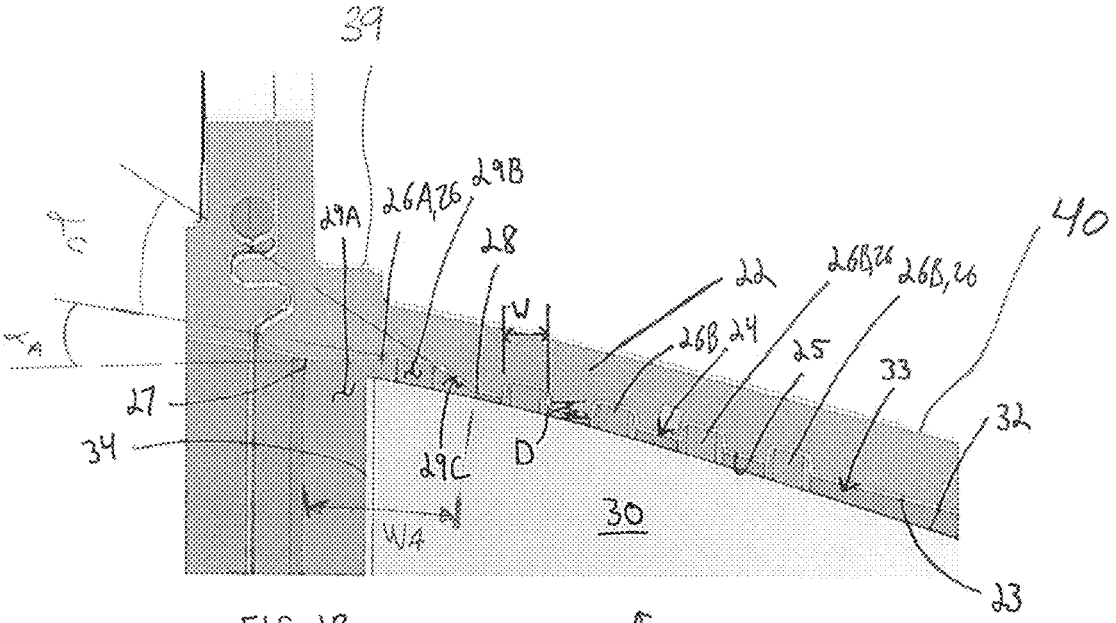
FIG. 2B is an enlarged view of the circled portion of FIG. 2A.
Figure 2A:
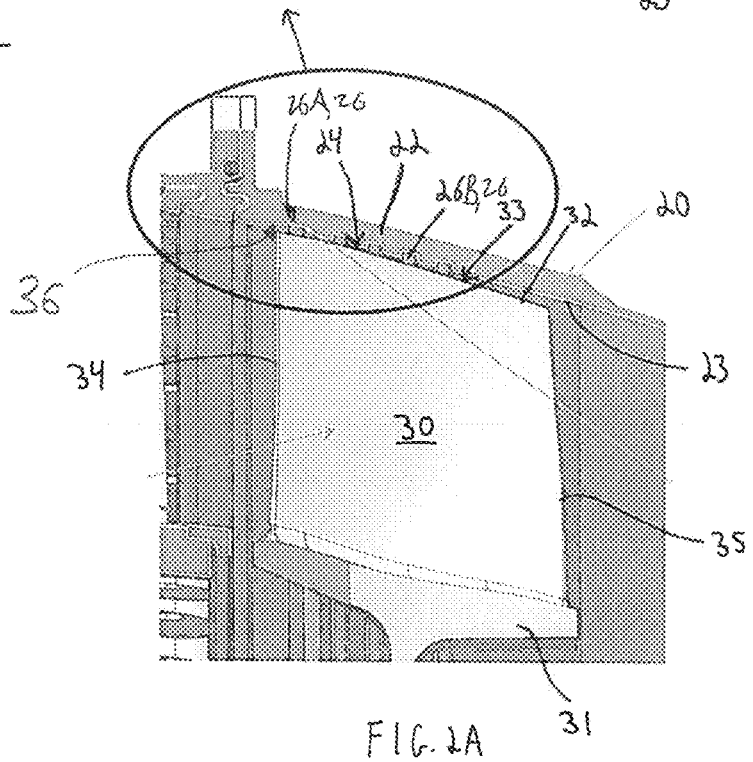
FIG. 2A is a partial cross-sectional view of a rotor blade casing of the gas turbine engine of FIG. 1.

FIGS. 2A and 2B provide cross-sectional views of part of the compressor casing 20. The casing 20 has a hollow annular casing body 22 which defines the corpus of the casing 20 and provides structure thereto. An inner circumferential surface 23 of the casing body 22 defines the interior of the casing 20 and faces the rotor blades 30. The inner surface 23 is exposed to the flow of air which is pressurized by the compressor section 14. In the embodiments shown in FIGS. 2A to 3, the casing body 22 is conical in shape and thus defines a conical gaspath therewithin. The conical shape of the casing body 22 tapers along an axial length of the casing 20. For example, an upstream cross-sectional portion 39 of the casing body 22 is larger relative to a downstream cross-sectional portion 40 of the casing body 22, and therefore the casing body (and consequently the gas path enclosed therewithin) axially narrows in a direction of the fluid flow through the gaspath.

The rotor blades 30 are mounted to a central shaft of the gas turbine engine and rotate about the center axis 11 within the casing body 22. Each rotor blade 30 has a radial extent and an axial extent. The radial extent is defined between a blade root 31 and a blade tip 32, the blade root 31 being positioned radially closer to the center axis 11 and the blade tip 32 being positioned radially closer to the inner surface 23 of the casing body 22. Each blade tip 32 is spaced radially apart from the inner surface 23 so as to define a tip clearance 33 volume. The axial extent of each rotor blade 30 is defined between a leading edge 34 which is the upstream extremity of the rotor blade 30 facing the oncoming air, and a trailing edge 35 which is the downstream extremity of the rotor blade 30.

An axially-extending abradable segment 24 of the casing body 22 is positioned between the inner surface 23 and the blade tips 32 of the rotor blades 30. The abradable segment 24 extends along an axial length of the inner surface 23, circumscribes the blade tips 32, and is radially spaced apart from the blade tips 32 across the tip clearance 33. The abradable segment 24 therefore forms an annular component that can be abraded or worn down by the blade tips 32 during operation of the gas turbine engine. The abradable segment 24 can extend over an axial length of the inner surface 23 that is defined at least between the leading and trailing edges 34,35 of the rotor blades 30. The axial length can be smaller so that the abradable segment 24 has an axial extent that is smaller than that of the rotor blades 30, or larger so that the abradable segment 24 has an axial extent that is larger than that of the rotor blades 30.

The abradable segment 24 is formed of, or includes, an abradable member 25. The abradable member 25 is a material or structural feature that can be worn down by rubbing from the blade tips 32, and is thus softer than the harder metal of the casing body 22. The abradable member 25 can thus be any treatment or feature capable of such functionality. For example, the abradable member 25 can be a coating applied to the inner surface 23 of the casing body 22. One possible coating includes an aluminum-polymer mix coating. This coating may be applied, such as by spraying or other suitable application methods, to the inner surface 23 of the casing 20. The abradable member 25 can also be a thicker and substantially solid (yet abradable) rub strip or other structural feature that is separate from the inner surface 23 and fixedly attached thereto.

The abradable segment 24 includes one or more annular grooves 26 formed. These grooves 26 may include a leading edge groove 26A, one or more intermediate grooves 26B, and/or a trailing edge groove 26C. The term "edge groove" as used herein is understood to include one or both of the leading edge groove 26A and the trailing edge groove 26C. The presently described rotor blade casing may include one or both of these edge grooves 26A and 26C. In the embodiment wherein a plurality of the intermediate grooves 26B, axially located between the leading edge and the trailing edge of the rotor blades, are provided, these plurality of grooves 26B, 26 are axially spaced apart, and may, in one particular embodiment, substantially equally spaced apart along the axial length of the abradable segment 24. In all cases, however, the annular grooves 26, 26A, 26B and/or 26C are defined in the surrounding material that is itself abradable. These grooves may be collectively referred to herein as annular grooves 26.

Each groove 26 extends into the casing body 22 from the inner surface 23 and thus defines a groove width W and a groove depth D. At least one or more of the grooves 26 circumscribe the blade tips 32 and are disposed axially between the leading and trailing edges 34,35 of the blade tips 32. The blade tips 32 do not rub against the voids defined by the grooved portions of the abradable segment 24. Therefore, each groove 26 reduces a contact area along which the blade tips 32 can contact, and rub against, the abradable segment 24.

More particularly, the contact area of the abradable segment 24 with the blade tips 32 can be defined by the axial length of the abradable segment 24 multiplied by its circumference along the inner surface 23 of the casing body 22. A groove area at the abradable segment 24, defined by the groove width W at the inner surface 23 multiplied by the circumference of the groove 26, is subtracted from the contact area for each groove 26.

The reduced contact area reduces the rubbing loads that are imparted to the rotor blades 30 when they engage the abradable member 25. It is therefore possible to lower the stresses experienced by the rotor blades 30 that are caused by the abradable segment 24, and thus reduce the likelihood that the rotor blades 30 may experience cracking or other structural issues.

For example, for the compressor rotor blades 30 of the embodiment of FIGS. 2A and 2B, it has been observed that conventional abradables imposed high rubbing loads on the blade roots 31 of the rotor blades 30, which is suspected of causing cracks to form in the blade roots 31. In contrast, the grooved abradable segment 24 disclosed herein is believed to reduce these rubbing loads, and thus prevent or reduce the likelihood of formation of cracks in the blade roots 31. It will be appreciated that the number of grooves 26 is not limited to the five shown in FIGS. 2A and 2B, and that the grooves 26 can have different cross-sectional shapes (e.g. conical, semi-circular, etc.) than those shown and described herein.

In the embodiment shown in FIGS. 2A and 2B, one of the grooves 26 may be a specially formed leading edge groove 26A. The leading edge groove 26A receives therein a radially distal portion of the leading edges 34 of the rotor blades 30 when they undergo rotational eccentricities. For example, the compressor rotor blades 30 shown in this embodiment have been observed to move axially forward or upstream and radially outward during some engine operating conditions, which would displace the leading edges 34 of the rotor blades into the leading edge groove 26A. As will be explained in greater detail below, the leading edge groove 26A has a depth and an axial location which is sufficient to prevent rubbing contact with the leading edges 34 (and blade tips 32 at the leading edges 34) of the rotor blades 30 while also minimising the tip clearance 33 and the aerodynamic losses associated therewith. The leading edge groove 26A is therefore able to reduce and/or eliminate the rubbing loads imparted to the leading edges 34 of the rotor blades 30, as it is known that the leading edges 34 of some rotor blades 30 are very sensitive to such loads.

The leading edge groove 26A extends axially between a first position 27 on the inner surface 23 upstream of the leading edges 34, and a second position 28 on the inner surface 23 downstream of the leading edges 34. In the depicted embodiment, the leading edge groove 26A defines a "pocket" 36 for receiving therein the leading edges 34 of the rotor blades 30. The groove width $W_A$ of the leading edge groove 26A is thus defined along the inner surface 23 between the first and second positions 27,28.

The leading edge groove 26A has an upstream wall 29A at the upstream portion of the leading edge groove 26A, a bottom wall 29B which defines the depth or extent of the leading edge groove 26A in the casing body 22, and a downstream wall 29C. The upstream wall 29A extends between the first position 27 and the bottom wall 29B, and the downstream wall 29C extends between the bottom wall 29B and the second position 28 on the inner surface 23.

In the embodiment shown, the upstream and downstream walls 29A,29C of the leading edge groove 26A are inclined relative to the inner surface 23, and form a triangular-shaped groove extending into the casing body 22 from the inner surface 23. The bottom wall 29B is positioned axially downstream of the first position 27 and axially upstream of the second position 28. The bottom wall 29B is thus axially offset from both the first and second positions 27,28 on the inner surface 23. In a particular embodiment, the bottom wall 29B is generally parallel to the inner surface 23. The upstream and downstream walls 29A,29C, which connect to the bottom wall 29B, therefore extend into the casing body 22 from the inner surface 23 at a non-perpendicular angle measured relative to the inner surface 23. In the embodiment shown in FIG. 2B, the upstream wall 29A is angled by an angle $\alpha_A$ in a anticlockwise direction, or radially inward, from the bottom wall 29B; and the downstream wall 29C is angled by an angle $\alpha_C$ in a clockwise direction, or radially inward, from the bottom wall 29B.

Figure 3:
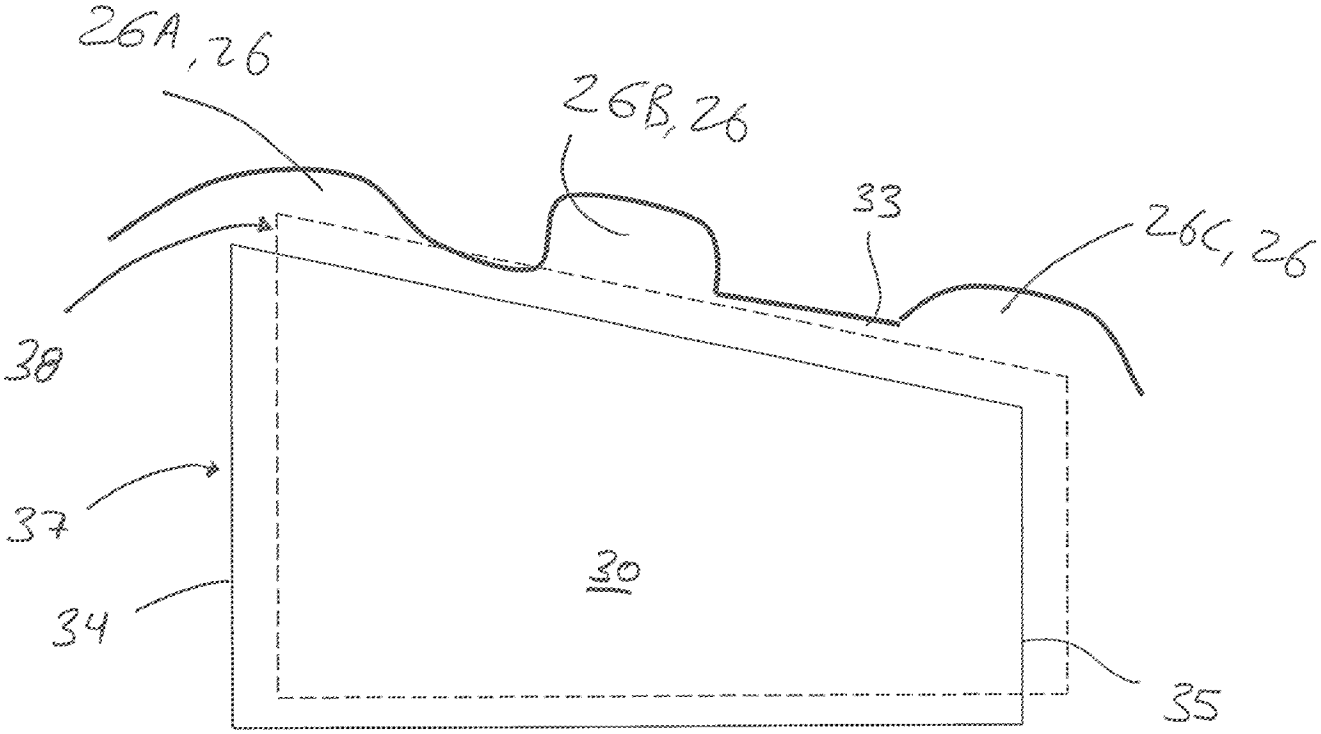
FIG. 3 is a schematic partial cross-sectional view of the rotor blade of FIG. 2B, shown in both an un-deflected position and a deflected position.

This profile of inclined upstream and downstream walls 29A,29C and the bottom plateau wall 29B helps to define the leading edge pocket 36 in the casing body 22 into which a portion of the rotor blades 30 defined at an intersection of the leading edges 34 and blade tips 32 can be received without abutting the inner surface 23 when the rotor blades 30 experience deflection, and this, for all engine operating conditions. Referring to FIG. 3, the rotor blade 30 is shown in the rest position, i.e. un-deflected position, 37, and in a deflected position 38. This inclined profile leading edge groove 26A also minimises the tip clearance 33 between the leading edges 34 and the inner surface 23, and thus minimises the aerodynamic losses associated with large tip clearances. For example, in the embodiment shown, the tip clearance 33 between the leading edges 34 and the inner surface 23 is minimized by the inclined upstream wall 29A. Increasing the angle $\alpha_A$ of the upstream wall 29A results in a decrease of the tip clearance 33 between the leading edges 34 and the inner surface 23, at least over a range of angle values.

Such a pocket 36 or profile in the casing body 22 can also be positioned elsewhere, and is not limited to being positioned adjacent to the leading edges 34 of the rotor blades 30. The pocket or groove in the casing body 22 can be positioned adjacent to any portion of the blade tips 32 which will experience radial movement during engine operation, and where it is desired that said portion of the blade tips 32 not engage with the casing body 22 and/or abradable segment 24. In an alternate embodiment, the pocket 36 is positioned adjacent to the trailing edges 35 for receiving therein the trailing edges 35 of the rotor blades 30.

Still referring to FIGS. 2A and 2B, the grooves 26 shown are relatively shallow, in that they are wider than they are deep. More particularly, at least some of the grooves 26 have a groove depth D that is about ⅓ to about ½ the groove width W. The groove depth D defines, in most instances, the absolute bottom depth that can be reached by the rotor blades 30 when the abradable segment 24 is rubbed or eroded by the blade tips 32. The groove width W is driven in large part by available manufacturing capabilities. The grooves 26 can be formed by any suitable machining technique such as turning and/or milling.

This contrasts with some conventional grooved compressor casings which have relatively deep and narrow grooves in order to improve the stall performance of the rotor blade. Such conventional grooves can have depths equal to at least two times the width of the grooves, and they are not implemented to attempt to control rub loads transferred to the rotor blade. Such grooves are often produced in metal casings for boost and high pressure compressor (HPC) components.

With cylindrical gaspath casings, the blade loads may remain generally steady as the blade rubs into the abradable and deflects forward. With a conical gaspath casing, such as that depicted in FIGS. 2A-3, the blade 30 may begin to disengage from the abradable material as it deflects forward, due to the rub. This forward deflection can un-load the blade tip 32, allowing it to spring back and dig back into the abradable. Should this occur, a cyclical load would be produced that can result in high cycle fatigue cracks in the blade 30. Consequently, the relative positioning and shape of the leading edge pocket 36 in the casing body 22 may help to avoid and/or reduce the likelihood of this occurring.

The tapered groove 26A which is positioned over the leading edge 34 of the rotor blade 30 provides some level of aerodynamic casing treatment benefit. Unlike traditional casing treatment grooves which are positioned over the top of the blade 30, the tapered groove 26A extends forward of the blade leading edge 34, to further reduce the blade loading even if the blade begins to deflect forward. The blade deflections are most sensitive to the leading edge 34 blade tip loads. However, the tapered groove 26A can also be positioned toward the trailing edge 35 to reduce tip clearance 33 adjacent to the trailing edge 35.

A possible operation of the rotor blade casing 20 will now be described with reference to FIGS. 2A and 2B.

During engine operation, the rotor blades 30 are rotating about the center axis and the tip clearance 33 is present between the abradable segment 24 of the casing body 22 and the blade tips 32. One or more of the rotor blades 30 may experience deflection or an eccentricity in its rotation which causes it to move towards the abradable segment 24 and through the tip clearance 33. If said rotor blade 30 engages the abradable member 25, rubbing will occur, which causes the abradable member 25 to be worn down. Since the blade tip 32 of said rotor 30 engages only the non-grooved portions of the abradable segment 24, it will experience less of a rubbing load than if it was engaging the entire abradable segment 24.

It can thus be appreciated that the grooved abradable segment 24 disclosed herein helps to reduce the blade rubbing load, while also minimizing the impact to operating tip clearance 33. Indeed, the non-grooved portions of the abradable segment 24 are very closely positioned to the blade tips 32, thereby minimizing the tip clearance 33 and the aerodynamic losses associated therewith.

The rotor blade casing 20 also allows for alleviating the effects of rubbing loads acting on specific portions of the rotor blades 30, such as by using the leading edge groove 26A. Other locations where the rotor blades 30 are "rub sensitive" can also be relieved with additional grooves 26. It is therefore possible to control the rub loads experienced by some or all of the rotor blades 30. This contrasts with some conventional profiled casings, which have identical grooves that are not adapted, positioned, or profiled to alleviate loads applied to specific portions of the rotor blades. It is thus possible with the present rotor blade casing 20 to relieve loads at specific points of the rotor blades 30, while leaving the loads unchanged at other points.

The above description is meant to be exemplary only, and one skilled in the art will recognize that changes may be made to the embodiments described without departing from the scope of the invention disclosed. For example, although described above as being a compressor casing 20, the rotor blade casing 20 can be another casing of the gas turbine engine, such as the fan blade casing, for example. Still other modifications which fall within the scope of the present invention will be apparent to those skilled in the art, in light of a review of this disclosure, and such modifications are intended to fall within the appended claims.

The invention claimed is:

1. A rotor blade casing for a gas turbine engine, the rotor blade casing adapted to enclose a rotor having a plurality of rotor blades and mounted to a shaft for rotation about a longitudinal center axis, each rotor blade extending radially between a blade root to a blade tip and extending axially between a leading edge and a trailing edge, the rotor blade casing comprising:

an annular casing body housing the rotor blades and having an inner circumferential surface, an abradable segment of the inner surface axially aligned with and facing the blade tips, the abradable segment comprising an abradable member adapted to be rubbed against by the blade tips when the rotor blades expand or deflect radially away from the longitudinal center axis during operation of the gas turbine engine, the abradable segment having one or more annular grooves extending radially outwardly into the casing body from the inner surface, the one or more annular grooves including a leading edge groove axially aligned with the leading edges of the rotor blades, the leading edge groove extending axially between a first position on the inner surface and a second position on the inner surface, the first position being axially upstream of the leading edges and the second position being axially downstream of the leading edges.

2. The rotor blade casing of claim 1, wherein the leading edge groove has an upstream wall, a bottom wall, and a downstream wall, the upstream wall extending radially between the first position on the inner surface and the bottom wall, and the downstream wall extending radially between the bottom wall and the second position on the inner surface.

3. The rotor blade casing of claim 2, wherein the upstream wall and the downstream wall are angled relative to the bottom wall, and the upstream and downstream walls extend radially outwardly from the first and second positions, respectively, to the bottom wall.

4. The rotor blade casing of claim 3, wherein the bottom wall is substantially parallel to the inner surface.

5. The rotor blade casing of claim 3, wherein the upstream wall is axially aligned with the leading edges of the rotor blades when the rotor blades are in an un-deflected position.

6. The rotor blade casing of claim 3, wherein the bottom wall is axially aligned with the leading edges of the rotor blades when the rotor blades are in a deflected position.

7. The rotor blade casing of claim 3, wherein the angled upstream wall has a slope that is less than that of the angled downstream wall relative to the bottom wall.

8. The rotor blade casing of claim 1, wherein the one or more annular grooves includes at least a second annular groove located downstream from the leading edge groove, the second annular groove being axially disposed in the abradable segment between the leading edges and the trailing edges of the rotor blades.

9. The rotor blade casing of claim 1, wherein the leading edge groove and the at least a second annular groove have a common depth extending radially into the abradable segment from the inner surface.

10. The rotor blade casing of claim 3, wherein a first angle between the bottom wall and the upstream wall is an obtuse angle and a second angle between the bottom wall and the downstream wall is an obtuse angle.

11. The rotor blade casing of claim 1, wherein the one or more annular grooves includes a trailing edge groove adjacent the trailing edges of the rotor blades, the trailing edge groove extending axially between a first position on the inner surface upstream of the leading edges and a second position on the inner surface downstream of the leading edges.

12. The rotor blade casing of claim 11, wherein the trailing edge groove has an upstream wall, a bottom wall, and a downstream wall, the upstream wall extending between the first position on the inner surface and the bottom wall, and the downstream wall extending between the bottom wall and the second position on the inner surface, the upstream and downstream walls being angled radially inward from the bottom wall.

13. The rotor blade casing of claim 1, wherein the casing body is conical and defines a conical gaspath therewithin, the casing having a larger upstream cross-sectional portion relative to a downstream cross-sectional portion thereof.

14. The rotor blade casing of claim 1, wherein at least some of the grooves have an axial width and a radial depth, the depth of said grooves being equal to about ⅓ to about ½ the width of said grooves.

15. A gas turbine engine comprising:

a rotor having a plurality of rotor blades and mounted to a shaft for rotation about a longitudinal center axis, each rotor blade extending radially between a blade root to a blade tip, and axially between a leading edge and a trailing edge; and an annular casing body housing the rotor blades and having an inner circumferential surface, an abradable segment of the inner surface facing the blade tips and spaced apart therefrom, the abradable segment comprising an abradable member being rubbed against by the blade tips when the rotor blades deflect during operation of the gas turbine engine, the abradable segment having one or more annular grooves extending into the casing body from the inner surface, the one or more annular grooves including an edge groove axially aligned with and facing the leading edge or the trailing edge of the rotor blades, the edge groove extending axially between a first position on the inner surface upstream of the leading edge or the trailing edge and a second position on the inner surface downstream of the leading edge or the trailing edge.

16. The gas turbine engine of claim 15, wherein the edge groove has an upstream wall, a bottom wall, and a downstream wall, the upstream wall extending between the first position on the inner surface and the bottom wall, and the downstream wall extending between the bottom wall and the second position on the inner surface.

17. The gas turbine engine of claim 15, wherein the edge groove is a leading edge groove axially aligned with and facing the leading edge of the rotor blades, the leading edge groove extending axially between the first position on the inner surface upstream of the leading edge and the second position on the inner surface downstream of the leading edge.

18. The gas turbine engine of claim 15, wherein the edge groove is a trailing edge groove adjacent the trailing edge of the rotor blades, the trailing edge groove extending axially between the first position on the inner surface upstream of the trailing edge and the second position on the inner surface downstream of the trailing edge.

19. The gas turbine engine of claim 16, wherein the upstream wall and the downstream wall are angled relative to the bottom wall, and the upstream and downstream walls extend radially outwardly from the first and second positions, respectively, to the bottom wall.

20. A method of manufacturing a rotor blade casing of a gas turbine engine, the method comprising:

providing an abradable member on at least a portion of an inner surface of the rotor blade casing; and forming one or more annular grooves in the abradable member at an axial location adapted to be axially aligned with blade tips of rotor blades enclosed by the rotor blade casing, the one or more annular grooves including an edge groove axially aligned with and adjacent to a leading edge or a trailing edge of the rotor blades.

* * * * *